US012247452B2

(12) United States Patent
McCormick et al.

(10) Patent No.: US 12,247,452 B2
(45) Date of Patent: Mar. 11, 2025

(54) SYSTEMS FOR REDUCING FLUID HAMMER IN SUBSEA SYSTEMS

(71) Applicant: TRANSOCEAN OFFSHORE DEEPWATER DRILLING INC., Houston, TX (US)

(72) Inventors: Craig McCormick, Houston, TX (US); Scott Reynolds, Houston, TX (US); Robert Mebane, Houston, TX (US); Mete Mutlu, Houston, TX (US); Jean Paul Buisine, Houston, TX (US)

(73) Assignee: TRANSOCEAN OFFSHORE DEEPWATER DRILLING INC., Houston, TX (US)

( * ) Notice: Subject to any disclaimer, the term of this patent is extended or adjusted under 35 U.S.C. 154(b) by 49 days.

(21) Appl. No.: 18/088,993

(22) Filed: Dec. 27, 2022

(65) Prior Publication Data

US 2023/0203905 A1 Jun. 29, 2023

Related U.S. Application Data

(60) Provisional application No. 63/293,866, filed on Dec. 27, 2021.

(51) Int. Cl.

| | |
|---|---|
| ***E21B 47/09*** | (2012.01) |
| ***E21B 33/035*** | (2006.01) |
| ***E21B 33/038*** | (2006.01) |
| ***E21B 33/06*** | (2006.01) |

(52) U.S. Cl.

CPC ..... *E21B 33/0355* (2013.01)

(58) Field of Classification Search

None

See application file for complete search history.

(56) References Cited

U.S. PATENT DOCUMENTS

| | | | | |
|---|---|---|---|---|
| 9,291,020 | B2 | 3/2016 | McWhorter et al. | |
| 9,664,005 | B2 | 5/2017 | Babbitt et al. | |
| 9,828,824 | B2 * | 11/2017 | McAuley | E21B 33/06 |
| 10,267,116 | B2 | 4/2019 | Babbitt et al. | |
| 10,287,842 | B2 * | 5/2019 | Bieneman | E21B 33/061 |

(Continued)

OTHER PUBLICATIONS

International Search Report and Written Opinion mailed Mar. 31, 2023 in International Application No. PCT/US2022/054042.

*Primary Examiner* — Matthew R Buck
*Assistant Examiner* — Douglas S Wood
(74) *Attorney, Agent, or Firm* — Panitch Schwarze Belisario & Nadel LLP

(57) ABSTRACT

A pumping system includes a plurality of pumps, each having an inlet and an outlet. The inlet is fluidly coupled to a hydraulic fluid reservoir. The outlet is fluidly coupled to a control pod having a valve and a pair of sensors monitoring upstream and downstream pressures of the valve. The control pod is fluidly coupled to a subsea blowout preventer. A first motor is coupled to a first pump of the plurality of pumps and sets the first pump at a first predetermined pressure. A controller is coupled to and configured to control the first motor, thereby controlling the first pump. The pumping system is configured to: engage and disengage each pump independently; and de-stroke each pump to limit pressure to the valve, when a predetermined pressure for each pump is attained, thereby reducing fluid hammer at the control pod.

24 Claims, 11 Drawing Sheets

(56) References Cited

U.S. PATENT DOCUMENTS

| | | | | |
|---|---|---|---|---|
| 10,767,438 | B2 * | 9/2020 | Papadimitriou | E21B 33/064 |
| 11,236,598 | B1 * | 2/2022 | Yeung | E21B 43/267 |
| 2002/0066596 | A1 | 6/2002 | Judge et al. | |
| 2009/0095464 | A1 | 4/2009 | McGrath et al. | |
| 2015/0096758 | A1 | 4/2015 | Babbitt | |
| 2015/0129233 | A1 * | 5/2015 | Gaude | E21B 34/04 166/344 |
| 2016/0108974 | A1 * | 4/2016 | Gwin | F16D 35/023 192/58.681 |
| 2016/0109874 | A1 * | 4/2016 | Holmes | E21B 33/0355 700/275 |
| 2016/0179106 | A1 * | 6/2016 | Connor, Jr. | E21B 33/064 251/30.01 |
| 2016/0222746 | A1 | 8/2016 | Gustafson | |
| 2017/0362929 | A1 | 12/2017 | Leach et al. | |
| 2018/0045012 | A1 | 2/2018 | Babbitt et al. | |
| 2018/0073320 | A1 * | 3/2018 | Holmes | E21B 34/16 |
| 2020/0011148 | A1 | 1/2020 | Babbitt et al. | |
| 2020/0407625 | A1 | 12/2020 | Stephenson | |
| 2022/0049568 | A1 | 2/2022 | Babbitt et al. | |
| 2023/0203905 | A1 * | 6/2023 | McCormick | E21B 33/0355 166/368 |

* cited by examiner

SYSTEMS FOR REDUCING FLUID HAMMER IN SUBSEA SYSTEMS

CROSS-REFERENCE TO RELATED APPLICATIONS

This application claims the benefit of priority under 35 USC § 119(e) of U.S. Provisional Patent Application No. 63/293,866 filed Dec. 27, 2021, the contents of which are incorporated by reference herein.

BACKGROUND OF THE DISCLOSURE

The present disclosure relates generally to a pumping system and a manifold system that may independently or cooperatively reduce fluid hammer in subsea drilling control systems. The present disclosure also relates to a method of using one or more such systems for reducing fluid hammer in subsea drilling systems.

SUMMARY OF THE DISCLOSURE

Briefly stated, one embodiment of a pumping system comprises a plurality of pumps, each having an inlet and an outlet. The inlet is fluidly coupled to a reservoir configured to provide a hydraulic fluid. The outlet is fluidly coupled to a control pod having a valve and a pair of sensors configured to monitor an upstream pressure and a downstream pressure of the valve. The control pod is fluidly coupled to a subsea blowout preventer. A first motor is coupled to a first pump of the plurality of pumps and configured to set the first pump at a first predetermined pressure. A controller is coupled to the first motor and configured to control the first motor, thereby controlling the first pump. The pumping system is configured to: engage and disengage each pump independently; and de-stroke each pump to limit pressure to the valve of the control pod, when a predetermined pressure for each pump is attained, thereby reducing fluid hammer at the control pod.

In some embodiments of the system, the controller comprises a variable frequency drive.

In some embodiments of the system, a battery is coupled to the controller.

In some embodiments of the system, the pumping system does not comprise a pressure regulator.

In some embodiments of the system, the system comprises at least three pumps.

In some embodiments of the system, the first predetermined pressure is about zero psi to about 5000 psi.

In some embodiments of the system, the first motor is a drive motor.

In some embodiments of the system, the first motor is coupled to a second pump of the plurality of pumps and configured to set the second pump at a second predetermined pressure.

In some embodiments of the system, a second motor is coupled to a second pump and is configured to set the second pump at a second predetermined pressure.

In some embodiments of the system, the sensors comprise transducers.

In some embodiments of the system, a pilot valve has a sensor operably coupled thereto, and the sensor is configured to detect activation of a function based on a sensed drop of pressure meeting a predetermined threshold.

In some embodiments of the system, the outlet is fluidly connected to a port of a flow plate of the control pod, the flow plate being configured to be fluidly coupled to the control pod.

One embodiment of a method of eliminating hydraulic pressure spikes in a system comprising the pumping system described above. The method comprises: selecting a valve from a plurality of valves in control pods; monitoring the upstream pressure and downstream pressure of the valve; and opening the valve when the upstream pressure is no more than a threshold value higher or lower than the downstream pressure.

In some embodiments of the method, the threshold value is about 500 psi.

Another embodiment of a manifold system comprises a plurality of valves operating in parallel. Each valve has a first inlet and a first outlet. The first inlet is fluidly coupled to a pump, the pump being fluidly coupled to a reservoir configured to provide a hydraulic fluid. The first outlet is fluidly coupled to a control pod, the control pod being fluidly coupled to a subsea blowout preventer. The manifold system is configured to close the valve once a predetermined pressure is attained, thereby isolating the predetermined pressure. A first sensor is positioned between the first inlet and the pump and is configured to monitor an upstream pressure of the valve. A second sensor is positioned between the first outlet and a flow plate of the control pod and is configured to monitor a downstream pressure of the valve. The flow plate has a port and is configured to be fluidly coupled to the control pod. The pump sets a pressure output based on the downstream pressure. A third valve has a second inlet and a second outlet. The second inlet is fluidly coupled to the pump. The second outlet is fluidly coupled to the reservoir. The dump valve is configured to: (a) test that the predetermined pressure may be attained before applying the predetermined pressure to the control pod; and (b) reset the upstream pressure of the valve to about zero psi.

In some embodiments of the system, the pump is coupled to a motor.

In some embodiments of the system, a controller is coupled to the motor.

In some embodiments of the system, the controller comprises a variable frequency drive.

In some embodiments of the system, a battery is coupled to the controller.

In some embodiments of the system, the first sensor or the second sensor comprises a transducer.

In some embodiments of the system, the system includes a second manifold system.

In some embodiments of the system, the second sensor is positioned between the first outlet and a port of a control plate of the control pod.

Another method of eliminating hydraulic pressure spikes in a system comprising the manifold system comprises: selecting a valve from the plurality of valves; monitoring the upstream pressure and downstream pressure of the valve; and opening the valve when the upstream pressure is no more than a threshold value psi higher or lower than the downstream pressure.

In some embodiments of the method, the threshold value is about 500 psi.

BRIEF DESCRIPTION OF THE SEVERAL VIEWS OF THE DRAWINGS

The following detailed description will be better understood when read in conjunction with the appended drawings. For the purpose of illustrating the invention, there are shown in the drawings various embodiments, including embodiments which may be presently preferred. It should be understood, however, that the invention is not limited to the precise arrangements and instrumentalities shown. In the drawings.

DETAILED DESCRIPTION OF THE INVENTION

Figure 1:
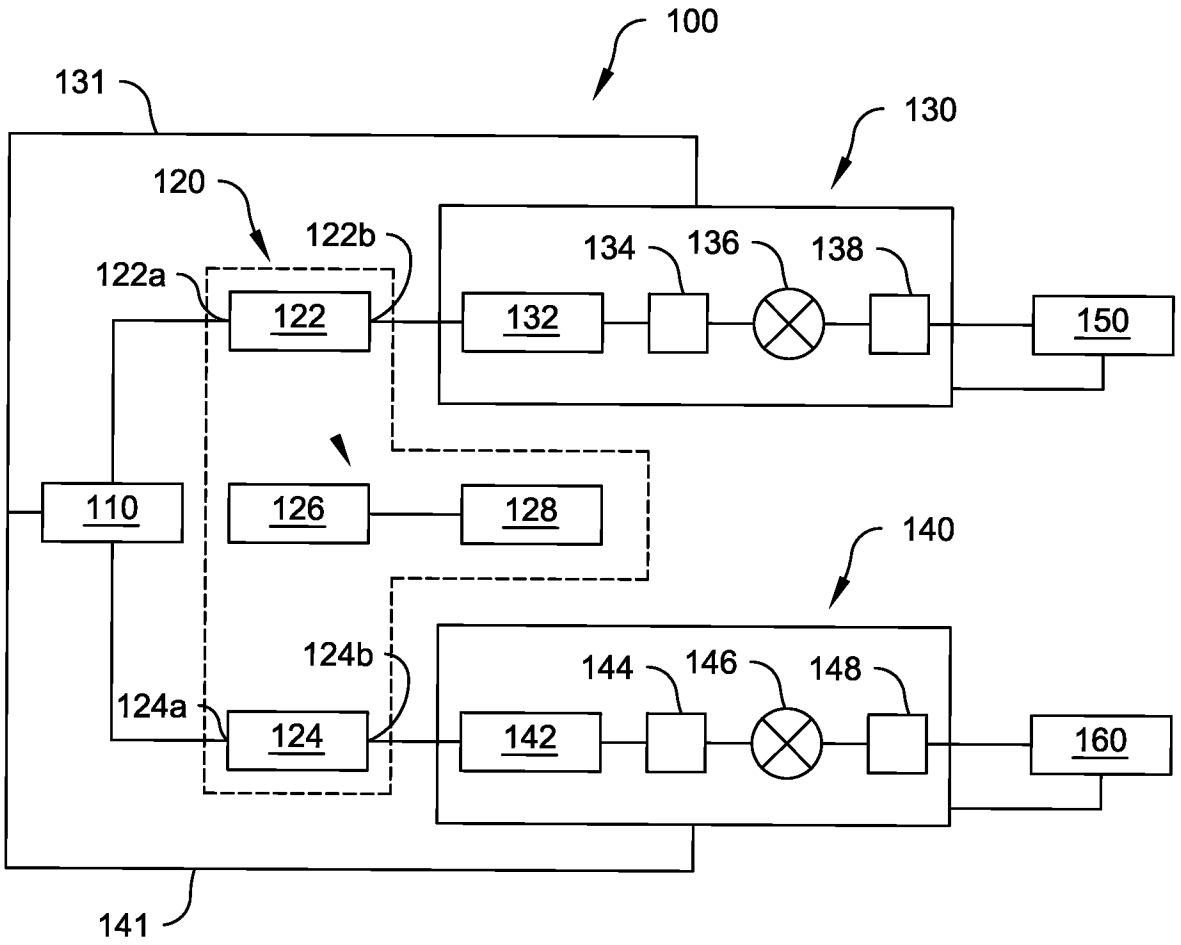
FIG. 1 is a diagram depicting a system 100, in accordance with some embodiments.

Certain terminology is used in the following description for convenience only and is not limiting. The words "right," "left," "lower," and "upper" designate directions in the drawings to which reference is made. The words "inner" and "outer" refer to directions toward and away from, respectively, the geometric center of an object and designated parts thereof. Unless specifically set forth otherwise herein, the terms "a," "an," and "the" are not limited to one element but instead should be read as meaning "at least one." "At least one" may occasionally be used for clarity or readability, but such use does not change the interpretation of "a," "an," and "the." Moreover, the singular includes the plural, and vice versa, unless the context clearly indicates otherwise. "Including" as used herein means "including but not limited to." The word "or" is inclusive, so that "A or B" encompasses A and B, A only, and B only. The terms "about," "approximately," "generally," "substantially," and like terms used herein, when referring to a dimension or characteristic of a component, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit thereof. The term "coupled" is defined as connected, although not necessarily directly, and not necessarily mechanically. Two items that are "coupled" may be unitary with each other. The terminology set forth in this paragraph includes the words noted above, derivatives thereof, and words of similar import.

In one aspect, the present disclosure relates to a pumping system that is capable of reducing fluid hammer in a subsea drilling control system for remotely operating a BOP. BOP control functions include, but are not limited to, the opening and closing of hydraulically operated pipe rams, annular seals, shear rams designed to cut the pipe, a series of remote operated valves to allow controlled flow of drilling fluids, a riser connector, and well re-entry equipment.

As shown in FIG. 1, in some embodiments, a system 100 may comprise a reservoir 110, a pumping system 120, a first control pod 130, a second control pod 140, a first subsea BOP component 150 coupled to the first control pod 130, and a second subsea BOP component 160 coupled to the second control pod 140.

The pumping system 120 may comprise a first pump 122, a second pump 124, a first motor 126, and a controller 128.

The first control pod 130 may comprise or be fluidly coupled to a first flow plate 132 having a port, a first upstream pressure sensor 134, a first control pod valve 136, and a first downstream pressure sensor.

The second control pod 140 may comprise or be fluidly coupled to a second flow plate 142 having a port, a second upstream pressure sensor 144, a second control pod valve 146, and a second downstream pressure sensor 148. Some embodiments of the control pods 130 and 140 are known in the art and are described, for example, in U.S. Pat. App. Pub. No. US20090095464A1 and U.S. Pat. No. 9,291,020, the contents of each of which are incorporated herein by reference.

In some embodiments, the control pod valves 136 and 146 may independently comprise a two-way valve, a three-way valve, a four-way valve, a two-position two-way valve, a two-position three-way valve, or a three-position four-way valve. In some embodiments, the pressure sensors 134, 138, 144, and 148 may independently comprise a transducer.

The first pump 122 may have a first inlet 122*a* and a first outlet 122*b*. The first inlet 122*a* may be fluidly coupled to the reservoir 110. In some embodiments, the reservoir 110 may comprise a container enclosing a hydraulic fluid. In some embodiments of systems or methods, the hydraulic fluid comprises an oil-based fluid, sea water, desalinated water, treated water, and/or water-glycol. In some embodiments, the hydraulic fluid comprises water-glycol. In some embodiments, the reservoir 110 may be the sea or a portion thereof. The first outlet 122*b* may be fluidly coupled fluidly coupled to the first control pod valve 136 and may be so coupled with or without being fluidly coupled to the port of the first flow plate 132. The first control pod 130 may be fluidly coupled to the first subsea BOP component 150 so as to control the first subsea BOP component 150. The first control pod 130 may be fluidly coupled to the reservoir 110 by a first return line 131 so as to return the hydraulic fluid from the first subsea BOP component 150 back to the reservoir 110. The first upstream pressure sensor 134 may be positioned upstream of the first control pod valve 136; may be positioned between the first flow plate 132 and the first control pod valve 136; and may be configured to monitor the upstream pressure of the first control pod valve 136. The first downstream pressure sensor 138 may be positioned between the first control pod valve 136 and the first subsea BOP component 150 and may be configured to monitor the downstream pressure of the first control pod valve 136.

The second pump 124 may have a second inlet 124*a* and a second outlet 124*b*. The second inlet 124*a* may be fluidly coupled to the reservoir 110. The second outlet 124*b* may be fluidly coupled to the second control pod valve 146 and may be so coupled with or without being fluidly coupled to the port of the second flow plate 142. The second control pod 140 may be fluidly coupled to the second subsea BOP component 160 so as to control the second subsea BOP component 160. The second control pod 140 may be fluidly coupled to the reservoir 110 by a second return line 141 so as to return the hydraulic fluid from the second subsea BOP component 160 back to the reservoir 110. The second upstream pressure sensor 144 may be positioned upstream of the second control pod valve 146; may be positioned between the second flow plate 142 and the second control pod valve 146; and may be configured to monitor the upstream pressure of the second control pod valve 146. The second downstream pressure sensor 148 may be positioned between the second control pod valve 146 and the second subsea BOP component 160 and may be configured to monitor the downstream pressure of the second control pod valve 146.

The first motor 126 may be coupled to the first pump 122 and the second pump 124 and configured to independently actuate the first pump 122 and the second pump 124. In some embodiments, the first motor 126 may be electrically actuated. For example, the first motor 126 may comprise any suitable electric motor, such as, for example, a synchronous alternating current (AC) motor, asynchronous AC motor, brushed direct current (DC) motor, brushless DC motor, permanent magnet DC motor, and/or the like. In some embodiments, the first motor 126 may comprise a drive motor. In some embodiments, the first motor 126 may be hydraulically actuated.

In some embodiments, instead of using the first motor 126 to actuate the second pump 124, a second motor may be used to actuate the second pump 124.

The controller 128 may be coupled to the first motor 126 and configured to control (e.g., activate, deactivate, change or set a rotational speed of, change or set of a direction of, and/or the like) the first motor 126. In some embodiments, the controller 128 may comprise an electric motor speed controller. In some embodiments, the controller 128 may comprise a variable frequency drive (VFD). In some embodiments, the controller 128 may comprise a programmable logic controller (PLC). The PLC may be configured to control a VFD, the control pod valve 136, and/or the control pod valve 146.

In some embodiments, the pumping system 120 may further comprise a battery coupled to the motor 126 and/or to the controller 128.

In some embodiments, the pumping system 120 may comprise a third pump. In some embodiments, the pumping system 120 may comprise 2-20 pumps, e.g., 2-15 pumps, 2-10 pumps, 3-20 pumps, or 3-10 pumps. Each pump may be controlled by its own motor. Alternatively, a single motor may be configured to control one or more pumps.

The pumping system 120 permits engaging and disengaging each pump independently. The pumping system 120 may deliver hydraulic fluid at a predetermined pressure on demand to individual control pods and does not require regulators or other devices to control pressure. When a predetermined pressure for each pump is attained, each pump is de-stroked to limit pressure to each control pod valve, thereby reducing fluid hammer at each control pod. In some embodiments, a pump may be a swash-plate pump, which may be "de-stroked" by varying the angle of the swash plate to reduce or eliminate the output of pressurized fluid from the pump. In other embodiments, a pump may be "de-stroked" by limiting output in another fashion, such as by stopping or limiting a speed of a motor driving the pump, or by venting or diverting some or all of the fluid output of the pump. In some embodiments, each control pod valve will not open until the upstream pressure is no more than a threshold value (e.g., about 500 psi) higher or lower than the downstream pressure, as measured by the sensors. In some embodiments, each control pod valve will not open until the upstream pressure is as close to zero, as is practical given limits of the components, higher or lower than the downstream pressure, as measured by the sensors. As a result, each control pod valve is never subject to delta pressure, or is subject to the minimum practical delta pressure, and control components are less likely to fail as a result.

In some embodiments, the predetermined pressure for each pump is about zero psi to about 5000 psi. For example, the predetermined pressure is about zero psi, about 500 psi, about 1000 psi, about 1500 psi, about 200 psi, about 2500 psi, about 3000 psi, about 3500 psi, about 4000 psi, about 4500 psi, or about 5000 psi.

The pumping system 120 may set the predetermined pressure for each pump independently. For example, the pumping system 120 may set the predetermined pressure for the first pump 122 to be about 1500 psi, and the predetermined pressure for the second pump 124 to be about 3000 psi.

Figure 2:
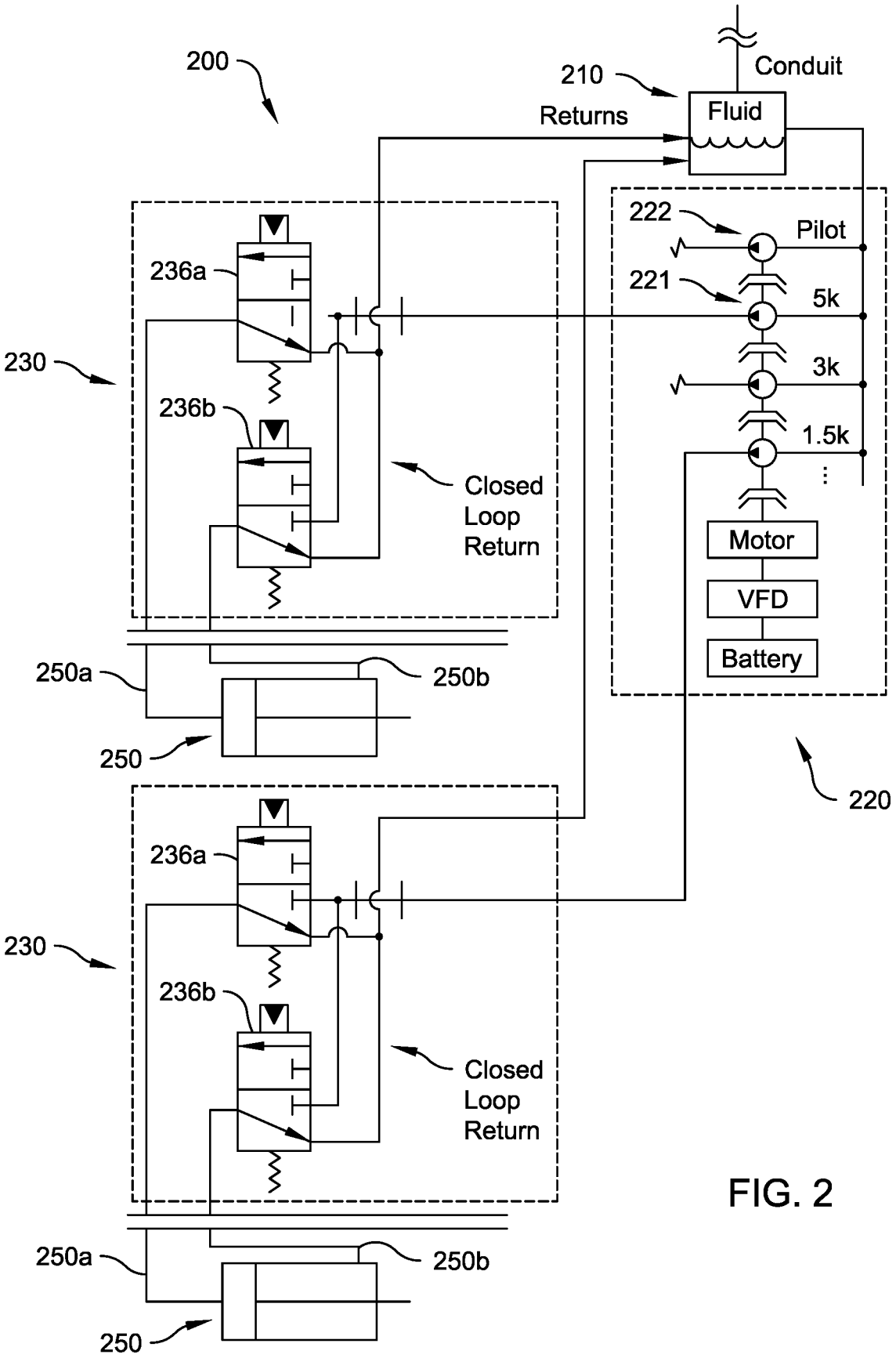
FIG. 2. is a diagram depicting a system 200, in accordance with some embodiments.

Related to the system 100, FIG. 2 shows a system 200 in accordance with some embodiments. The system 200 may comprise a pumping system 220. The pumping system 220 may comprise a plurality of pumps 220 operating in parallel, wherein each pump 222 may have a predetermined pressure. The pilot pressure, as indicated by the term "pilot" in FIG. 2, is monitored to indicate if and/or when a function has been activated. A drop in pilot pressure (e.g., a rapid drop or drop beyond a predetermined threshold), for example, may be detected, indicating that a function has been activated and therefore supply pressure has been demanded, causing one or more pumps to deliver fluid to a control pod. When a predetermined pressure for each pump 222 is attained, each pump 222 may de-stroke, as indicated by the symbol 221. As shown in FIG. 2, a single motor may be configured to control or drive the plurality of pumps 222.

The system 200 may comprise a control pod 230 configured to control a subsea BOP component 250. The control pod 230 may comprise (a) a valve **236*a* that may be fluidly coupled to an inlet of the BOP component 250, and (b) a valve 236*b* that may be fluidly coupled to an outlet of the BOP component 250. In some embodiments, the valve 236*b* may be fluidly coupled to a reservoir 210**.

In some embodiments, the control pod 230 may employ solenoid valves that may direct the pilot pressure to the valve **236*a* to open the path between the pump 222 and the inlet/outlet of the BOP component 250**. The pilot pressure may be about 3,000 psi, and a pilot accumulator may be used to store a pressurized hydraulic fluid.

In some embodiments, the detection of control system command and solenoid valve operation may be performed by: (a) monitoring the pressure with a pressure transducer, and (b) capturing a control system command by detecting a rapid pressure drop in the pilot accumulator.

In some embodiments, the detection of control system command and solenoid valve operation may be performed by: (a) monitoring the flow rate at the outlet of the pilot accumulator with a flow meter or flow switch, and (b) capturing a control system command by detecting a rapid flow rate increase at the pilot accumulator output.

In some embodiments, the detection of control system command and solenoid valve operation may be performed by: (a) monitoring the pressure before valve **236*a* and valve 236*b* with a pressure transducer while holding a low pressure (200 psi) before these valves, and (b) capturing a control system command by detecting a rapid pressure drop when valve 236***a* or valve 236*b* is opened. A gas-charged accumulator may be used to increase the control system command capture capability.

Figure 3:
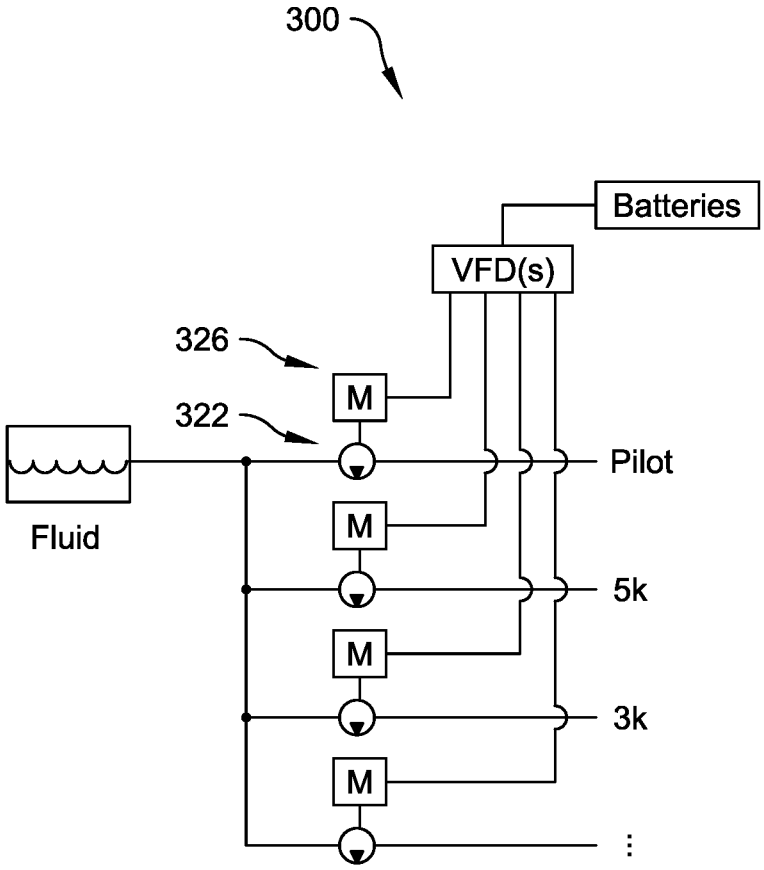
FIG. 3. is a diagram depicting a multi-pump system 300, in accordance with some embodiments.

Related to the pumping system 120, FIG. 3 shows a pumping system 300 in accordance with some embodiments. The pumping system 300 may comprise a plurality of pumps 322 operating in parallel, where each pump 322 may have a predetermined pressure. Each pump 322 may be independently controlled by a motor 326.

In one aspect, the present disclosure relates to a manifold system that is capable of reducing fluid hammer in a subsea drilling control system for remotely operating a subsea BOP.

Figure 4:
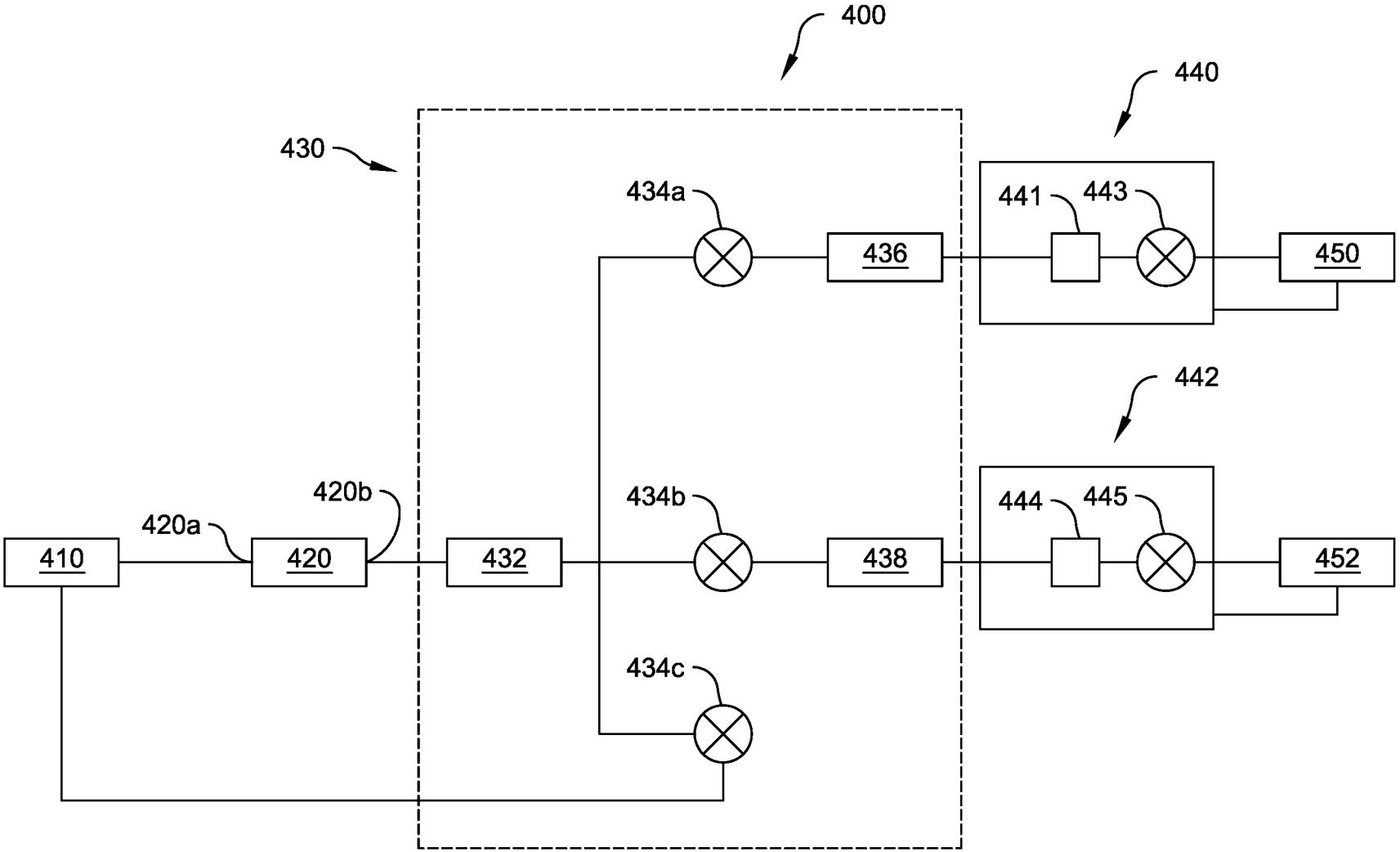
FIG. 4 is a diagram depicting a system 400 having a manifold system, in accordance with some embodiments.

As shown in FIG. 4, in some embodiments, a system 400 may comprise a reservoir 410, a pump 420, a manifold system 430, a first control pod 440, a second control pod 442, a first subsea BOP component 450, and a second subsea BOP component 452.

The manifold system 430 may comprise an upstream pressure sensor 432, a first valve 434*a*, a second valve 434*b*, a third valve which may be referred to as a dump valve 434*c*, a first downstream pressure sensor 436, and a second downstream pressure sensor 438. Any of the valves may include any suitable device for providing flow or pressure relief, including a manual valve, hydraulic valve, pneumatic valve, PRV and/or another suitable valve.

The pump 420 may have an inlet 420*a* and an outlet 420*b*. The inlet 420*a* of the pump 420 may be fluidly coupled to the reservoir 410. In some embodiments, the reservoir 410 may comprise a container enclosing a hydraulic fluid. In some embodiments, any reservoir—including, for example, the reservoir 410—may be the sea or a portion thereof, or the atmosphere or a portion thereof. The outlet 420*b* of the pump 420 may be fluidly coupled to the upstream pressure sensor 432.

The upstream pressure sensor 432 may be fluidly coupled to an inlet of the first valve 434*a*, an inlet of the second valve 434*b*, and an inlet of the dump valve 434*c*. The upstream pressure sensor 432 may be configured to monitor an upstream pressure of the valves 434*a*, 434*b*, and 434*c*.

In some embodiments, each of the pressure sensors 432, 436, and 438 may comprise a transducer.

An outlet of the first valve 434*a* may be fluidly coupled to the first downstream pressure sensor 436, which may be configured to monitor a downstream pressure of the first valve 434*a*. The first downstream pressure sensor 436 may be fluidly coupled the first control pod 440 and may be so coupled by being fluidly coupled to a first flow plate 441. The first flow plate 441 may comprise a port. The first control pod 440 may further comprise a first control pod valve 443 that may be fluidly coupled to the first subsea BOP component 450 so as to control the first subsea BOP component 450.

An outlet of the second valve 434*b* may be fluidly coupled to the second downstream pressure sensor 438, which may be configured to monitor a downstream pressure of the second valve 434*b*. The second downstream pressure sensor 438 may be fluidly coupled to the second control pod 442 and may be so coupled by being fluidly coupled to a second flow plate 444. The second flow plate 444 may comprise a port. The second control pod 442 may further comprise a second control pod valve 445 that may be fluidly coupled to the second subsea BOP component 452 so as to control the second subsea BOP component 452.

An outlet of the dump valve 434*c* may be fluidly coupled to the reservoir 410. The dump valve 434*c* may be used for availability testing, i.e., testing that a predetermined pressure may be attained before applying the predetermined pressure to the first control pod 440 or the second control pod 442. As such, the dump valve 434*c* permits an offline, nonintrusive test while conducting operations. The dump valve 434*c* may be configured to reset the upstream pressure of the first valve 434*a* and/or the second valve 434*b* to about zero psi.

In some embodiments, each of the valves 434*a*, 434*b*, 434*c*, 443, and 445 may comprise a two-way valve, a three-way valve, or a four-way valve, a two-position two-way valve, a two-position three-way valve, or a three-position four-way valve.

The pump 420 may be configured to set a pressure output based on the downstream pressure as measured by the downstream pressure sensors 436 or 438. In some embodiments, the valves 434*a* or 434*b* will not open until the upstream pressure (as may be measured by the upstream pressure sensor 432) is no more than about 500 psi higher or lower than the downstream pressure, as measured by the downstream pressure sensors 436 or 438. In some embodiments, each control pod valve will not open until the upstream pressure is as close to zero, as is practical given limits of the components, higher or lower than the downstream pressure, as measured by the sensors. As the control pod 440 or 442 attains a predetermined pressure, the valve 434*a* or 434*b* is closed to isolate the pressure.

In some embodiments, the system 400 may further comprise a motor coupled to the pump 420 and configured to control the pump 420. In some embodiments, the system 400 may further comprise a controller coupled to the motor and configured to control (e.g., activate, deactivate, change or set a rotational speed of, change or set of a direction of, and/or the like) the motor. In some embodiments, the controller may comprise an electric motor speed controller. In some embodiments, the controller may comprise a VFD. In some embodiments, the controller may comprise a PLC. The PLC may be configured to control a VFD, and/or the valves 434*a*, 434*b*, 434*c*, 443, and 445. In some embodiments, the system 400 may further comprise a battery coupled to the controller.

Figure 5:
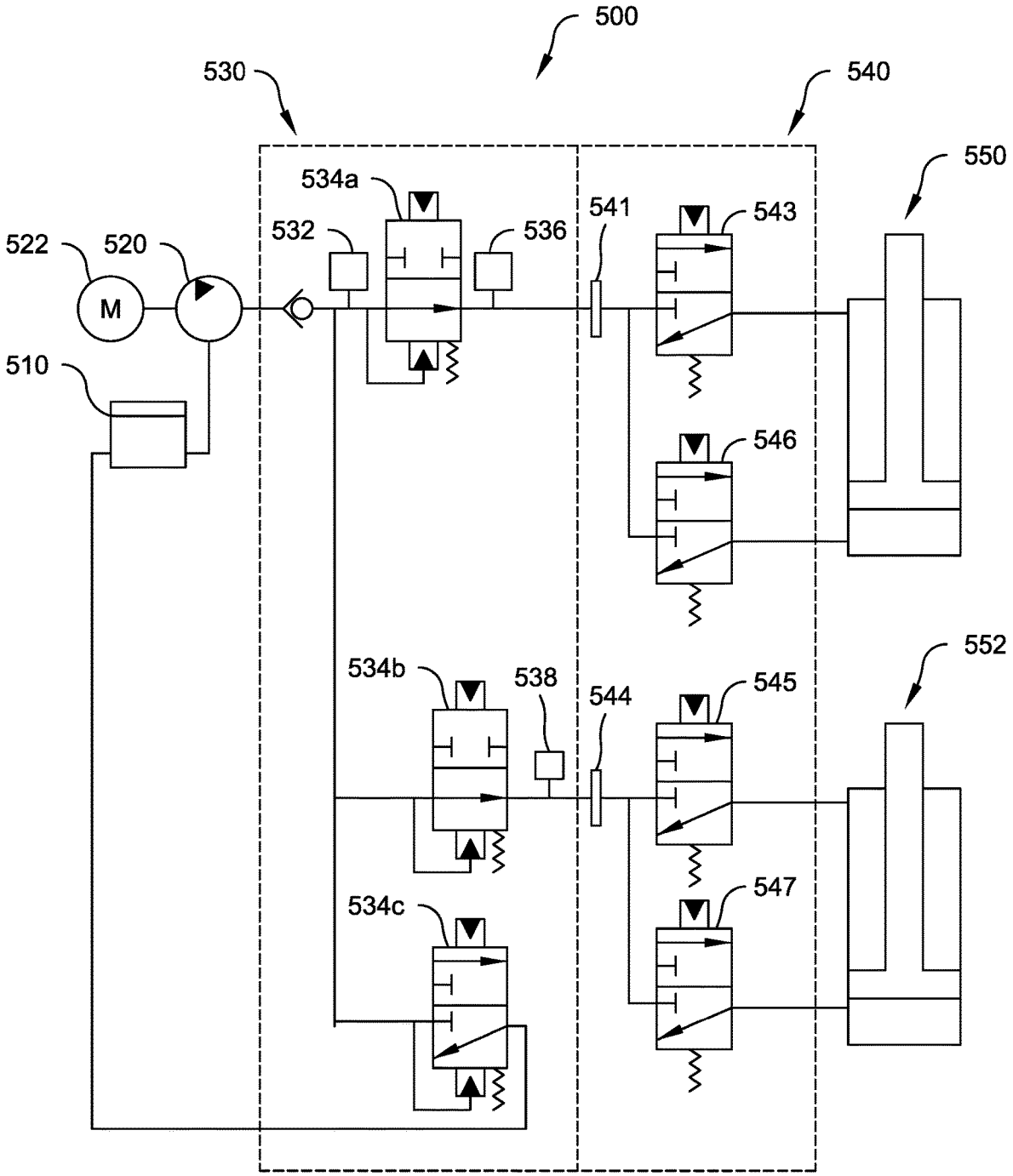
FIG. 5 is a diagram depicting a system 500 having a manifold system, in accordance with some embodiments.

Related to the system 400, FIG. 5 shows a system 500 comprising a reservoir 510, a pump 520, a motor 522, an integrated manifold assembly (IMA) 530, a control pod 540, a first subsea BOP component 550, and a second subsea BOP component 552.

The IMA 530 may comprise an upstream pressure sensor 532, a first main-stage valve 534*a*, a second main-stage valve 534*b*, a dump valve 534*c*, a first downstream pressure sensor 536, and a second downstream pressure sensor 538.

The control pod 540 may comprise a first flow plate 541 having a port, a first control pod valve 543, a second control pod valve 546, a second flow plate 544 having a port, a third control pod valve 545, and a fourth control pod valve 547.

The first main-stage valve 534*a* may be fluidly coupled to the first control pod valve 543 and the second control pod valve 546 and may be so coupled by being fluidly coupled to the first flow plate 541, which may be fluidly coupled to the second control pod valve 543. Both control pod valves 543 and 546 may be fluidly coupled to the first subsea BOP component 550. The first control pod valve 543 may be configured to control the first subsea BOP component 550. The second control pod valve 546 may be configured to close a ram (or other BOP components).

The second main-stage valve 534*b* may be fluidly coupled the third control pod valve 545 and the second control pod valve 547 and may be so coupled by being fluidly coupled to the second flow plate 544, which may be fluidly coupled to the third control pod valve 545. Both control pod valves 545 and 547 may be fluidly coupled to the second subsea BOP component 552. The third control pod valve 545 may be configured to control the second subsea BOP component 552. The fourth control pod valve 547 may be configured to close an annular (or other BOP components).

Figure 6:
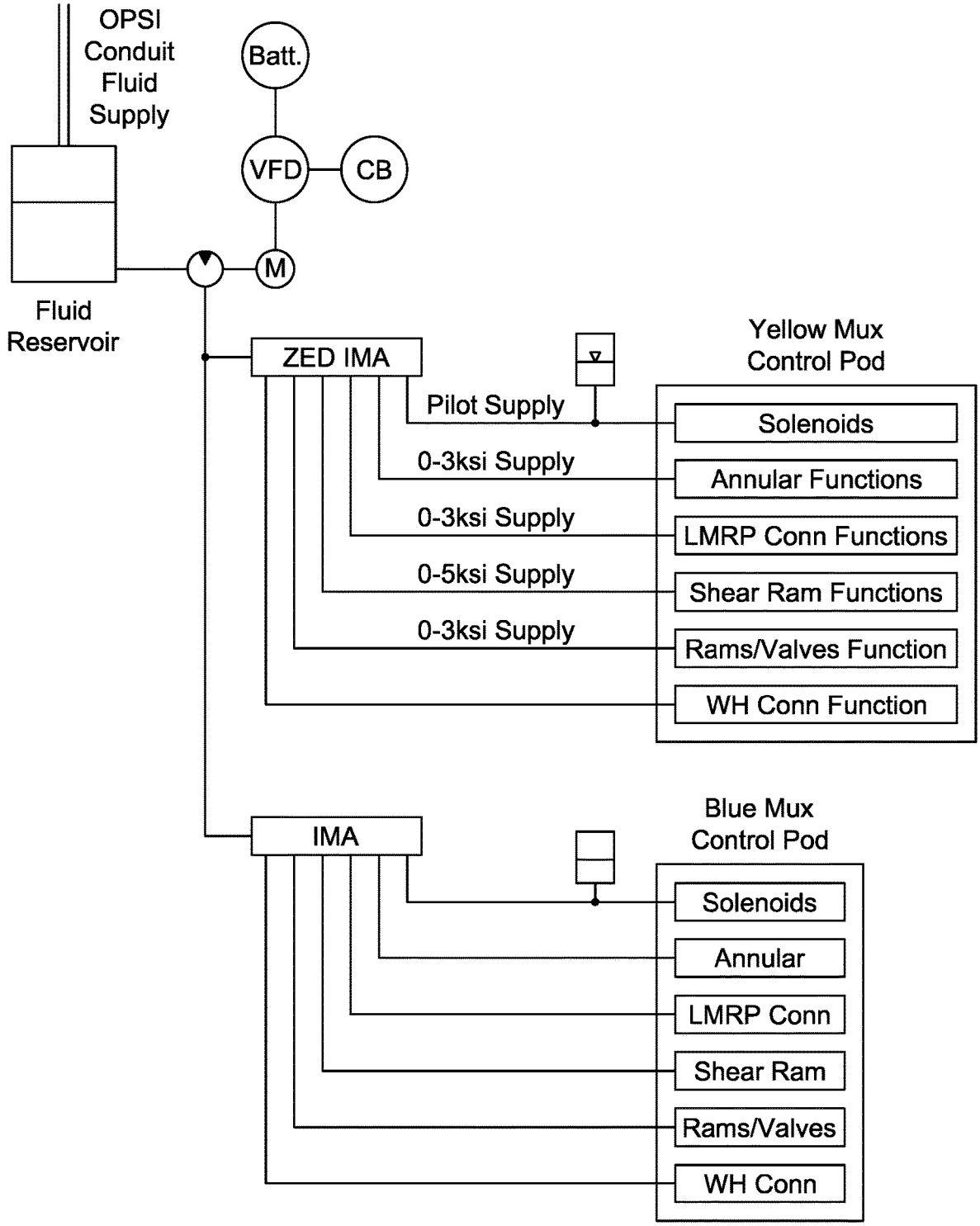
FIG. 6 is a diagram depicting a system having two manifold systems operating in parallel, in accordance with some embodiments.

Related to the systems 400 and 500, FIG. 6 shows a system where two IMAs (integrated manifold assemblies) may be operating in parallel. The two IMAs may comprise a ZED IMA and a generic IMA. Each of the ZED IMA and the IMA may be configured to provide hydraulic fluid at a particular pressure to a particular type of device, which may be a hydraulically operated device of a BOP.

Figure 7:
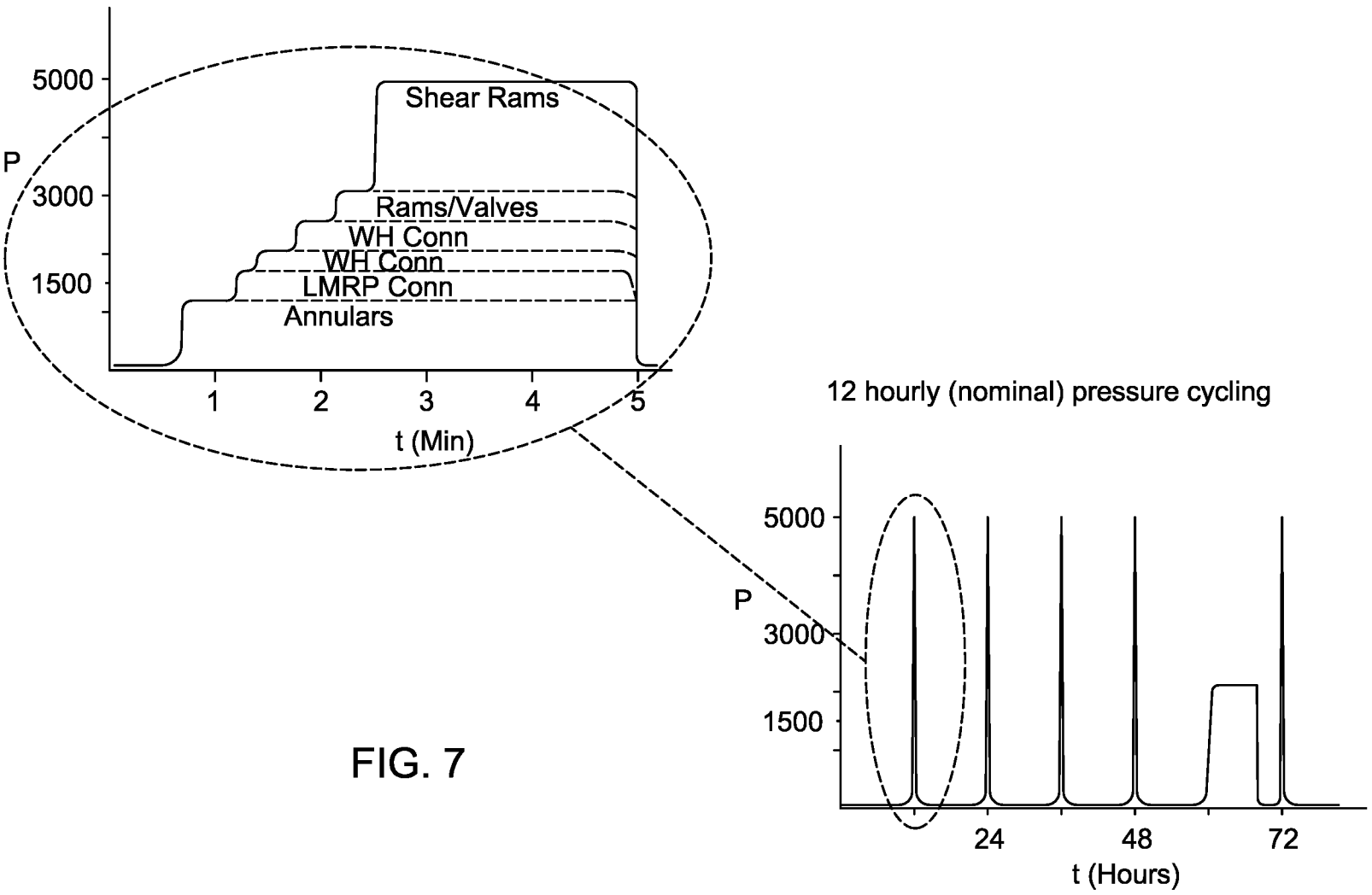
FIG. 7 is a schematic depicting a method to confirm hydraulic integrity, in accordance with some embodiments.
Figure 8:
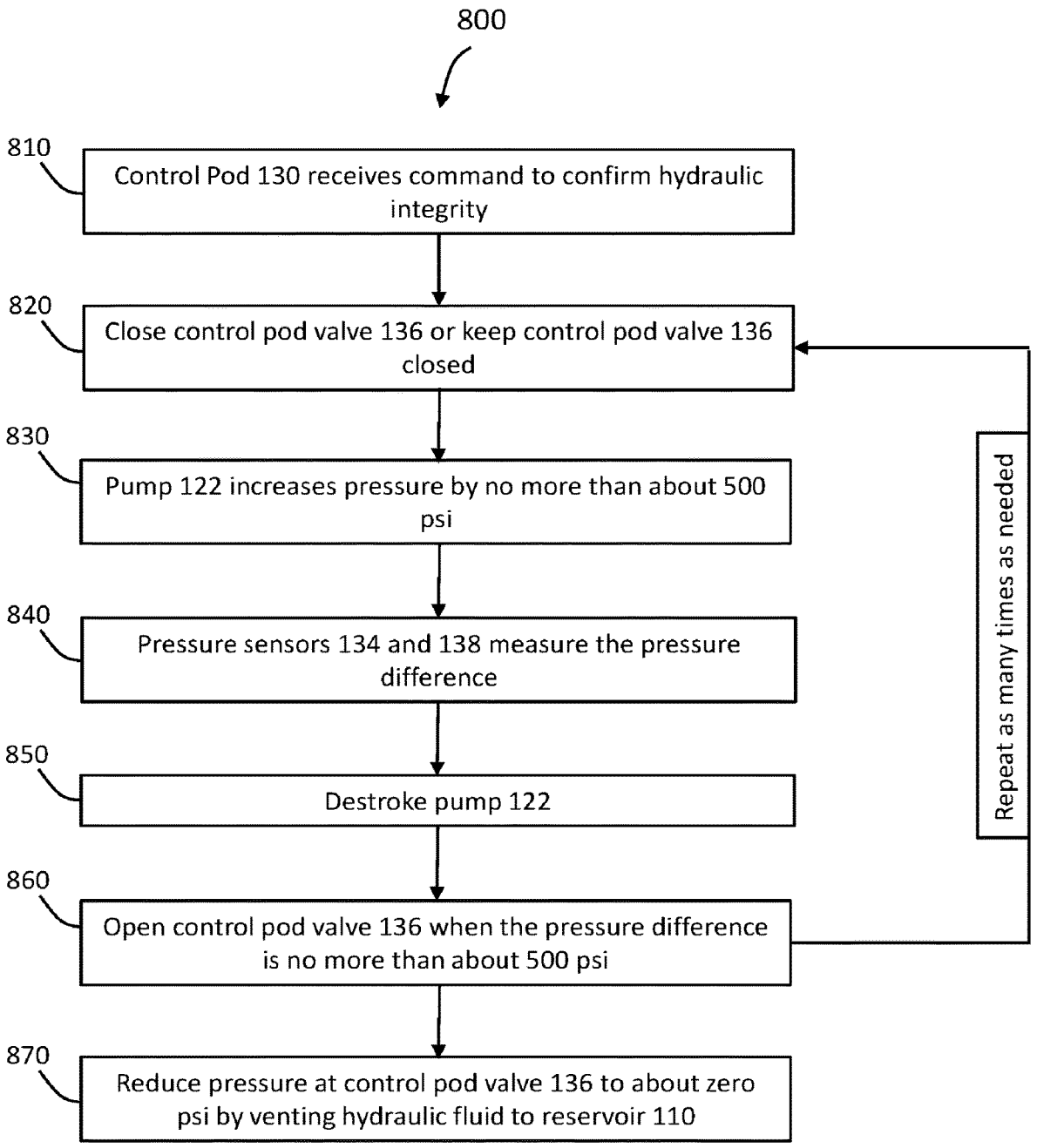
FIG. 8 is a flowchart illustrating a method 800 of confirming hydraulic integrity in the system 100 under drilling mode, in accordance with some embodiments.
Figure 9:
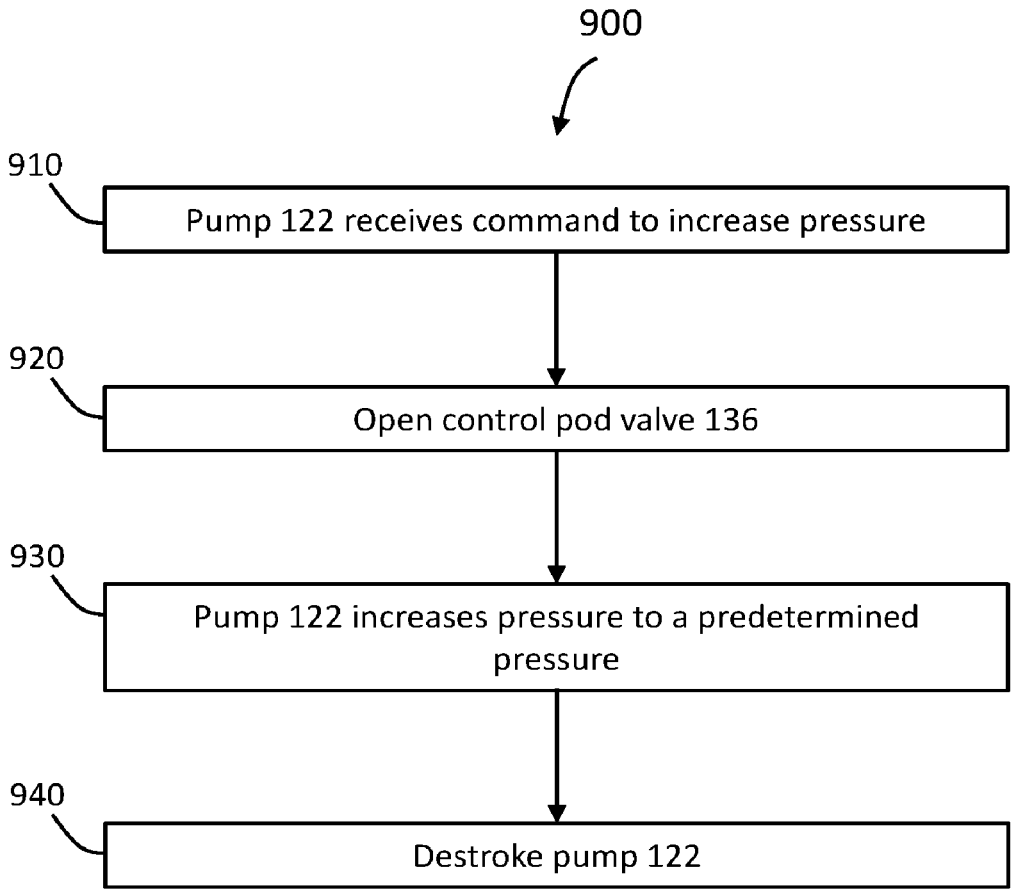
FIG. 9 is a flowchart illustrating a method 900 of delivering pressure to the system 100 under non-drilling mode, in accordance with some embodiments.

The operations of the pumping system described herein under drilling mode or non-drilling mode are described in FIGS. 7-9. Under drilling mode, typically about 50% of the control pod valves are open to their stack mounted functions, routinely (e.g., about every 12 hours) the system ramps pressure to confirm hydraulic integrity, as illustrated in FIG. 7. As indicated in FIG. 7, in an embodiment of a method according to the invention, pressure may be cycled approximately every 12 hours, with pressure increasing stepwise to an appropriate pressure to operate various BOP functions, including annulars, LMRP, WH, rams/valves, and shear rams. FIG. 8 is a flowchart illustrating a method 800 of confirming hydraulic integrity in the system 100 under drilling mode. The method 800 comprises at step 810, the control pod 130 receiving command to confirm hydraulic integrity. At step 820, the method 800 comprises closing the control pod valve 136 if not closed or keeping it closed. At step 830, the pump 122 increases pressure by no more than about 500 psi. After the pressure increase, at step 840, the pressure sensors 134 and 138 measure the upstream and downstream pressures respectively, thereby providing a pressure difference. At step 850, the pump 122 is de-stroked. Subsequently at step 860, when the pressure difference is no more than about 500 psi, the control pod valve 136 is open. Steps 820-860 may be repeated as many times as needed until a desirable pressure is reached at the control pod valve 136. In some embodiments the desirable pressure is about 5000 psi, about 4500 psi, about 4000 psi, about 3500 psi, or about 3000 psi. At step 870, the pressure at the control pod valve 136 is reduced to about zero psi by venting the hydraulic fluid back to the reservoir 110.

Confirmation of hydraulic integrity may result in eliminating or substantially eliminating hydraulic pressure spikes in a system. In some embodiments, the present disclosure relates to a method of eliminating hydraulic pressure spikes in a system comprising the pumping system described herein. In some embodiments, the method comprises: (a) selecting a control pod valve from a plurality of control pod valves, (b) monitoring the upstream and downstream pressures of the selected control pod valve, and (c) opening the selected control pod valve when the upstream pressure is no more than about 500 psi higher or lower than the downstream pressure.

FIG. 9 is a flowchart illustrating a method 900 of delivering pressure to the system 100 under non-drilling mode. Non-drilling mode, may include, for example, various well-control events. As examples, non-drilling mode may include closing a ram, shearing or sealing an annular, aligning a tubular, conducting a test (e.g., a pressure test), adjusting a drilling string, or any event associated with adjusting (e.g., closing or altering access to) the wellbore. The method 900 comprises at step 910, the pump 122 receiving command to increase pressure. At step 920, before the pump 122 increases the pressure, the method 900 comprises opening the control pod valve 136. At step 930, the pump 122 increases the pressure to a predetermined pressure. At step 940, the pump 122 de-strokes to limit the pressure to the control pod valve 136.

Figure 10:
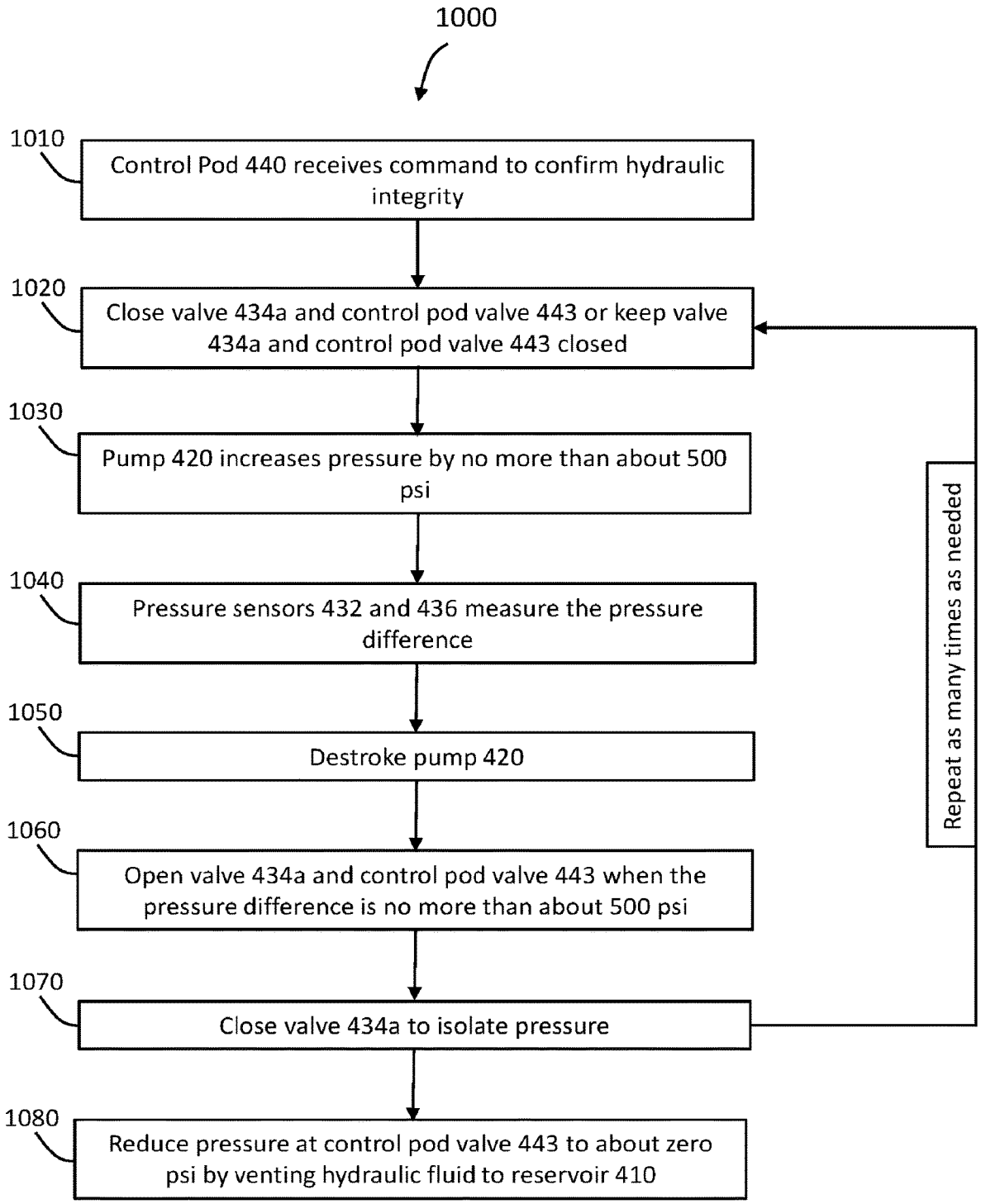
FIG. 10 is a flowchart illustrating a method 1000 of confirming hydraulic integrity in the system 400 under drilling mode, in accordance with some embodiments.
Figure 11:
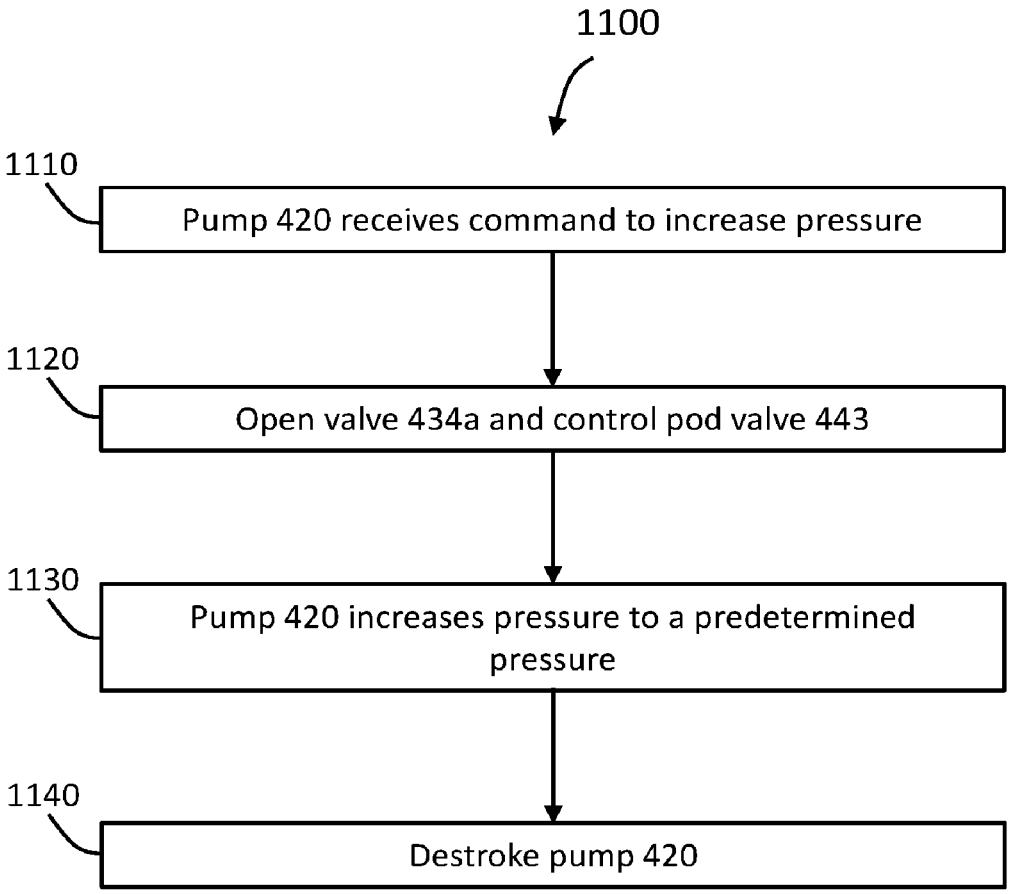
FIG. 11 is a flowchart illustrating a method 1100 of delivering pressure to the system 400 under non-drilling mode, in accordance with some embodiments.

The operations of the manifold system described herein under drilling mode or non-drilling mode are described in FIGS. 7 and 10-11. Under drilling mode, typically about 50% of the control pod valves are open to their stack mounted functions, routinely (e.g., about every 12 hours) the system ramps pressure to confirm hydraulic integrity, as illustrated in FIG. 7. FIG. 10 is a flowchart illustrating a method 1000 of confirming hydraulic integrity in the system 400 under drilling mode. The method 1000 comprises at step 1010, the control pod 440 receiving command to confirm hydraulic integrity. At step 1020, the method 1000 comprises closing the valve 434*a* and control pod valve 443 or keeping the valve 434*a* and control pod valve 443 closed. At step 1030, the pump 420 increases pressure by no more than about 500 psi. After the pressure increase, at step 1040, the pressure sensors 432 and 436 measure the upstream and downstream pressures respectively, thereby providing a pressure difference. At step 1050, the method 1000 comprises de-stroking the pump. Subsequently at step 1060, when the pressure difference is no more than about 500 psi, the method 1000 comprises opening the valve 434*a* and control pod valve 443. At step 1070, the method 1000 comprises closing valve 434*a* to isolate the pressure. Steps 1020-1070 may be repeated as many times as needed until a desirable pressure is reached at the control pod valve 443. In some embodiments the desirable pressure is about 5000 psi, about 4500 psi, about 4000 psi, about 3500 psi, or about 3000 psi. At step 1080, the pressure at the control pod valve 443 is reduced to about zero psi by venting the hydraulic fluid back to the reservoir 410.

In some embodiments, the present disclosure relates to a method of eliminating hydraulic pressure spikes in a system comprising the manifold system described herein. In some embodiments, the method comprises: (a) selecting a valve in the manifold system from the plurality of valves, (b) monitoring the upstream and downstream pressures of the selected valve, and (c) opening the selected valve when the upstream pressure is no more than about a threshold value higher or lower than the downstream pressure. In some embodiments, the threshold value is about 500 psi.

FIG. 11 is a flowchart illustrating a method 1100 of delivering pressure to the system 400 under non-drilling mode. The method 1100 comprises at step 1110, the pump 420 receiving command to increase pressure. At step 1120, before the pump 420 increases the pressure, the method 1100 comprises opening the valve 434*a* and the control pod valve 443. At step 1130, the pump 420 increases the pressure to a predetermined pressure. At step 1140, the pump 420 de-strokes to limit the pressure to the control pod valve 443.

In some embodiments, the control pod in the pumping system or manifold system may be coupled to an electronic multiplex control system ("MUX"), through which an operator on the surface may control and/or monitor BOP functions and hydraulic supply. (See FIG. 6.) In a simple sense, the MUX allows an operator to control BOP functions by the push of buttons or the like. For example, the operator closes an annular by pressing a button or inputting an electronic command to signal the hydraulic system to close the annular. In some embodiments, the present invention is integrated into an existing multiplex system such that the initiation of backup hydraulic supply may be commanded by the push of a button. In addition, software may allow the switch between normal flow and backup flow to be transparent in that the operator pushes the same button to control a particular function whether normal or backup flow used.

Valves of the present disclosure (e.g., main-stage valves) may comprise any suitable valve, such as, for example spool valves, poppet valves, ball valves and/or the like, and unless specified, may comprise any suitable configuration, such as, for example, two-position two-way (2P2W), 2P3W, 2P4W, 3P4W, and/or the like. Valves of the present disclosure may be normally closed (e.g., which may increase fault tolerance, for example, by providing failsafe functionality), or normally open. In some embodiments, valves that are configured to directly control hydraulic fluid communication to and/or from a hydraulically actuated device are configured to withstand hydraulic fluid pressures of up to 7,500 pounds per square inch gauge (psig) or larger and ambient pressures of up to 5,000 psig, or larger. Any of the valve may be actuated in any suitable fashion, such as, for example, hydraulically, pneumatically, electrically, mechanically, and/or the like.

In some embodiments, the pumping system and the manifold system described herein may be coupled together in the same system to work cooperatively to reduce fluid hammer in subsea drilling control systems.

In addition, any combination of two or more features, systems, articles, materials, kits, and/or methods, if such features, systems, articles, materials, kits, and/or methods are not mutually inconsistent, is included within the inventive scope of the present disclosure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present disclosure as defined by the appended claims.

We claim:

1. A pumping system comprising:

a plurality of pumps each having an inlet and an outlet, the inlet being fluidly coupled to a reservoir configured to provide a hydraulic fluid, the outlet being fluidly coupled to a control pod having a valve and a pair of sensors configured to monitor an upstream pressure and a downstream pressure of the valve, wherein the control pod is fluidly coupled to a subsea blowout preventer;

a first motor coupled to a first pump of the plurality of pumps and configured to set the first pump at a first predetermined pressure;

a controller coupled to the first motor and configured to control the first motor, thereby controlling the first pump;

wherein the pumping system is configured to:

engage and disengage each pump independently; and de-stroke each pump to limit pressure to the valve of the control pod, when a predetermined pressure for each pump is attained, thereby reducing fluid hammer at the control pod.

2. The pumping system of claim 1, wherein the controller comprises a variable frequency drive.

3. The pumping system of claim 1, further comprising a battery coupled to the controller.

4. The pumping system of claim 1, wherein the pumping system does not comprise a pressure regulator.

5. The pumping system of claim 1, comprising at least three pumps.

6. The pumping system of claim 1, wherein the first predetermined pressure is about zero psi to about 5000 psi.

7. The pumping system of claim 1, wherein the first motor is a drive motor.

8. The pumping system of claim 1, wherein the first motor is coupled to a second pump of the plurality of pumps and configured to set the second pump at a second predetermined pressure.

9. The pumping system of claim 1, further comprising a second motor coupled to a second pump and configured to set the second pump at a second predetermined pressure.

10. The pumping system of claim 1, wherein the sensors comprise transducers.

11. The pumping system of claim 1, further comprising a pilot valve with a sensor operably coupled thereto, the sensor configured to detect activation of a function based on a sensed drop of pressure meeting a predetermined threshold.

12. The pumping system of claim 1, wherein the outlet is fluidly connected to a port of a flow plate, the flow plate being configured to be fluidly coupled to the control pod.

13. A method of eliminating hydraulic pressure spikes in a system comprising the pumping system of claim 1, the method comprising:

selecting a valve from a plurality of valves in control pods;

monitoring the upstream pressure and downstream pressure of the valve; and opening the valve when the upstream pressure is no more than a threshold value higher or lower than the downstream pressure.

14. The method of claim 13, wherein the threshold value is about 500 psi.

15. A manifold system comprising:

a plurality of valves operating in parallel, each having a first inlet and a first outlet, the first inlet being fluidly coupled to a pump, the pump being fluidly coupled to a reservoir configured to provide a hydraulic fluid, the first outlet being fluidly coupled to a control pod, the control pod being fluidly coupled to a subsea blowout preventer, wherein the manifold system is configured to close the valve once a predetermined pressure is attained, thereby isolating the predetermined pressure;

a first sensor positioned between the first inlet and the pump and configured to monitor an upstream pressure of the valve;

a second sensor positioned between the first outlet and the control pod and configured to monitor a downstream pressure of the valve, wherein the pump sets a pressure output based on the downstream pressure; and a dump valve having a second inlet and a second outlet, the second inlet being fluidly coupled to the pump, the second outlet being fluidly coupled to the reservoir, wherein the dump valve is configured to: (a) test that the predetermined pressure may be attained before applying the predetermined pressure to the control pod; and (b) reset the upstream pressure of the valve to about zero psi.

16. The manifold system of claim 15, wherein the pump is coupled to a motor.

17. The manifold system of claim 15, further comprising a controller coupled to the motor.

18. The manifold system of claim 17, wherein the controller comprises a variable frequency drive.

19. The manifold system of claim 17, further comprising a battery coupled to the controller.

20. The manifold system of claim 15, wherein the first sensor or the second sensor comprises a transducer.

21. The manifold system comprising of claim 15, further comprising a second manifold system according to claim 15.

22. The manifold system of claim 15, wherein the second sensor is positioned between the first outlet and a port of a control plate fluidly connected to the control pod.

23. A method of eliminating hydraulic pressure spikes in a system comprising the manifold system of claim 15, the method comprising:

selecting a valve from the plurality of valves, monitoring the upstream pressure and downstream pressure of the valve; and opening the valve when the upstream pressure is no more than a threshold value psi higher or lower than the downstream pressure.

24. The method of claim 23, wherein the threshold value is about 500 psi.

* * * * *